US006669791B2

(12) United States Patent
Tetsui et al.

(10) Patent No.: US 6,669,791 B2
(45) Date of Patent: Dec. 30, 2003

(54) TIAL BASED ALLOY, PRODUCTION PROCESS THEREFOR, AND ROTOR BLADE USING SAME

(75) Inventors: Toshimitsu Tetsui, Nagasaki (JP); Kentaro Shindo, Nagasaki (JP); Masao Takeyama, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/789,540

(22) Filed: Feb. 22, 2001

(65) Prior Publication Data

US 2001/0022946 A1 Sep. 20, 2001

(30) Foreign Application Priority Data

Feb. 23, 2000 (JP) ..... 2000-046540
Aug. 29, 2000 (JP) ..... 2000-259831

(51) Int. Cl.[7] ..... C22C 14/00
(52) U.S. Cl. ..... 148/421; 420/418; 420/420
(58) Field of Search ..... 420/418, 420; 148/421

(56) References Cited

U.S. PATENT DOCUMENTS

| | | | | |
|---|---|---|---|---|
| 5,226,985 A | | 7/1993 | Kim et al. | |
| 5,284,620 A | * | 2/1994 | Larsen, Jr. | 420/590 |
| 5,442,847 A | | 8/1995 | Semiatin et al. | |
| 5,558,729 A | | 9/1996 | Kim et al. | |
| 5,846,351 A | | 12/1998 | Masahashi et al. | |
| 6,051,084 A | * | 4/2000 | Tetsui | 148/421 |

FOREIGN PATENT DOCUMENTS

| | | | |
|---|---|---|---|
| DE | 43 18 424 | | 12/1994 |
| JP | 62-000215 | | 1/1987 |
| JP | 64-042539 | | 2/1989 |
| JP | 1-259139 | | 10/1989 |
| JP | 1-298127 | | 12/1989 |
| JP | 4-066630 | | 3/1992 |
| JP | 4-124236 | | 4/1992 |
| JP | 6-49624 | | 2/1994 |
| JP | 6-041661 | | 2/1994 |
| JP | 6-049565 | | 2/1994 |
| JP | 6-340955 | | 12/1994 |
| JP | 08-120372 A | * | 5/1996 |
| WO | WO 96/30551 | | 10/1996 |

OTHER PUBLICATIONS

"ASM Handbook: vol. 3 Alloy Phase Diagrams", ASM International, 1992, p 254.*

D. Zhang, et al., Intermetallics, vol. 7, No. 10, XP–004177382, pps. 1081–1087, "Characterization of Controlled Microstructures in a γ–TiAl(Cr, Mo, Si, B) Alloy, " Oct. 1999.

* cited by examiner

*Primary Examiner*—Roy King
*Assistant Examiner*—Janelle Combs-Morillo
(74) *Attorney, Agent, or Firm*—Oblon, Spivak, McClelland, Maier & Neustadt, P.C.

(57) ABSTRACT

A TiAl based alloy having excellent strength as well as an improvement in toughness at room temperature, in particular an improvement in impact properties at room temperature, and a production method thereof, and a blade using the same are provided. This TiAl based alloy has a microstructure in which lamellar grains having a mean grain diameter of from 1 to 50 μm are closely arranged. The alloy composition is Ti-(42–48)Al-(5–10) (Cr and/or V) or Ti-(38–43)Al-(4–10) Mn. The alloy can be obtained by subjecting the alloy to high-speed plastic working in the cooling process, after the alloy has been held in an equilibrium temperature range of the α phase or the (α+β) phase.

5 Claims, 9 Drawing Sheets

STEP A

STEP B

20 μm

5 μm

STEP A'

STEP B'

TIAL BASED ALLOY, PRODUCTION PROCESS THEREFOR, AND ROTOR BLADE USING SAME

BACKGROUND OF THE INVENTION

1. Field of the Invention

The present invention relates to TiAl based alloys, a production process therefor, and a rotor blade using the same.

2. Description of Related Art

Recently, as materials used for a turbine blade of a turbocharger, a turbine engine or the like, and materials used for future aircraft, TiAl based alloys, being lightweight (specific gravity of about 4) and having excellent heat-resistance, are attracting much attention. In particular, in the case of a large blade, as the constituent material of the blade become lighter, the centrifugal stress becomes smaller, thus enabling improvement in the maximum attainable rpm, an increase in blade area, and a decrease in applied stress on the disk portion.

This TiAl based alloy is an alloy composed mainly of TiAl and $Ti_3Al$, which is an intermetallic compound having excellent high temperature strength. As described above, it has excellent heat resistance, but has a problem in that ductility at room temperature is poor. Therefore, various measures have been heretofore taken, such as control of the microsstructure or ternary addition. For example, in Japanese Unexamined Patent Application, First Publication No. Hei 6-49565, there is disclosed a technique in which Cr or V is added as the ternary addition, in order to improve the ductility of the TiAl based alloy at normal temperature. Furthermore, a laminated structure (lamellar structure) region obtained by alternately laminating the TiAl phase and the $Ti_3Al$ phase is formed in a matrix structure in order to improve the strength. Moreover, Kim (Young-Won Kim. Intermetallics. (6) 1998 pp. 623–628) has reported that in a TiAl alloy having a lamellar grain with a mean grain diameter of from 30 to 3000 $\mu$m, as the mean grain diameter of the lamellar grains increases, the ductility and tensile stress at a room temperature decrease.

The case of the above described technique however, is not sufficient in view of improvement in ductility at a normal temperature. In particular, with a blade used for an engine for industrial use or the like, foreign matter such as sludge may collide with the blade at the time of operation, or at the time of production of the blade, the blade may be broken due to impact at the time of fixing the blade to the outer periphery of the disk with a hammer. Hence, it becomes necessary to improve the impact property of the TiAl based alloy. With the above technique however, it is difficult to improve the impact property.

Furthermore, in many cases the TiAl based alloy has been heretofore produced by casting. However the casting structure is generally large, and there is a tendency for the impact property of a material to decrease further. In the case of casting, production of small parts such as vehicle parts is relatively easy. However production of large parts has been difficult due to problems with flowability of the molten metal in the mold. On the other hand, isothermal forging is also commonly used as a forging method of the TiAl based alloy. Here, in order to develop a lamellar structure, it is necessary to pass through a zone in which the $\alpha$-phase exists. With the isothermal forging, however, there is a problem in that since processing at a high temperature of 1150° C. or higher is not possible due to problems of the apparatus, the lamellar structure necessary for improvement of the mechanical property is not developed in the forged material. In addition, production of large parts is also difficult.

BRIEF SUMMARY OF THE INVENTION

The present inventors consider that it is essential to form the above described lamellar grains in the matrix, sin order to improve the strength of the TiAl based alloy. Based on this assumption, the present inventors have changed the mean grain diameter of the lamellar grains to various sizes, and have found that the ductility at room temperature, in particular, the impact property can be greatly improved for a predetermined mean grain diameter, thereby concluding the present invention.

Moreover, the present invention is in conceiving as a method for reducing the mean grain diameter of the lamellar structure, one wherein a TiAl based alloy material is held in an equilibrium temperature range of an $\alpha$ phase or in an equilibrium temperature range of an ($\alpha$+$\beta$) phase, and then the material is subjected to high-speed plastic working in the cooling process thereafter. The invention is also in finding a specific method for this method.

That is to say, it is an object of the present invention to solve the above described problems in the TiAl based alloy and to provide a TiAl based alloy excellent in workability, and with excellent strength as well as an improvement in ductility at room temperature, in particular, an improvement in the impact properties at room temperature, and a production process therefor.

It is an another object of the present invention to provide a blade comprising a TiAl based alloy having improved impact properties.

To achieve the above objects, the TiAl based alloy of the present invention is characterized by having a fine structure in which lamellar grains having a mean grain diameter of from 1 to 50 $\mu$m are closely arranged, with an $\alpha_2$ phase and a $\gamma$ phase being laminated therein alternately. More specifically, the TiAl based alloy of the present invention is characterized by two kinds of fine structures, one being a structure form (hereinafter, referred to as "structure 1") in which lamellar grains having a mean grain diameter of from 1 to 50 $\mu$m are closely arranged, with the $\alpha_2$ phase and the $\gamma$ phase being laminated therein alternately, and the other being a structure form (hereinafter, referred to as "structure 2") in which a matrix composed mainly of a $\beta$ phase fills the gaps between the lamellar grains in the form of net work, and the ratio of this matrix is not smaller than 10% and not larger than 40%.

By having such a microstructure, the strength is improved by means of the lamellar grains themselves formed in the metal structure, and since the lamellar grains having a small grain diameter distribute closely and finely, ductility at room temperature, in particular, impact resistance is improved. As other properties, with the structure 1, since the high temperature strength increases, it can be used as a turbine blade of a gas turbine or the like. Moreover, with the structure 2, high temperature deformability is improved due to the effect of the $\beta$ phase between the lamellar grains, making plastic working easy. However, the creep strength slightly decreases. Therefore, it can be used as a turbine blade of a steam turbine or the like having a low upper limit for the operating temperature.

In order to achieve the above objects, one of the TiAl based alloys of the present invention may be a TiAl based alloy having a composition comprising 40 to 48 atomic % of Al, 5 to 10 atomic % of one or more kinds selected from Cr and V, with the remainder being Ti and inevitable impurities. The TiAl based alloy having this composition has an equilibrium range of α phase or (α+β) phase, which is wide at a high temperature. Moreover, according to a production method of the present invention described below, this TiAl based alloy is easily subjected to high-speed plastic working, and becomes a fine microstructure in which lamellar grains are closely arranged. As a result, a TiAl based alloy having excellent ductility at a room temperature, and in particular, excellent impact properties can be obtained. The structure 1 can be obtained by holding the TiAl based alloy in the α region, and the structure 2 can be obtained by holding the TiAl based alloy in the (α+β) region.

Another TiAl based alloy of the present invention may be a TiAl based alloy having a composition comprising 38 to 48 atomic % of Al, 4 to 10 atomic % of Mn, with the remainder being Ti and inevitable impurities. Also in the TiAl based alloy having this composition, the high-temperature equilibrium range of the α phase or (α+β) phase exists, and similarly, by holing the TiAl based alloy in the α region, the structure 1 can be obtained, and by holing the TiAl based alloy in the (α+β) region, the structure 2 can be obtained. With this structure, since the structure 1 and structure 2 are less hard than the above described TiAl based alloy, the machinability and impact resistance are improved. However, the high temperature strength slightly decreases. Therefore, the structure 1 and structure 2 are suitable for applications where this TiAl based alloy is used at a slightly lower temperature than the above described TiAl based alloy.

An other TiAl based alloy of the present invention is a TiAl based alloy relating to the above described two kinds of TiAl based alloys, further containing one or more kinds of elements selected from the group consisting of C, Si, Ni, W, Nb, B, Hf, Ta, and Zr in an amount of from 0.1 to 3 atomic % in total.

By adding these elements in a small amount, the high temperature strength, the creep strength and the oxidation resistance can be increased.

The TiAl based alloy of the present invention has a Charpy impact value specified in JIS-Z2242, of 3J or higher at a room temperature, and 5J or higher is also achievable at room temperature, according to conditions. Since this TiAl based alloy has such excellent impact value, if it is used for the turbine blades of an engine turbocharger or various types of turbine, it becomes possible to improve turbine efficiency due to the increase in rpm, and to contribute to lightening the weight, while maintaining durability against impact, that is, reliability.

A method for obtaining the structure 1 described above, which is one method for obtaining the TiAl based alloy of the present invention, is a production method of a TiAl based alloy characterized by comprising: a step for holding a TiAl based alloy material containing Al at least in an amount of from 43 to 48 atomic % in an equilibrium temperature range of an α phase; and a step for subjecting the TiAl based alloy material held at that temperature to high-speed plastic working, while cooling the material to a predetermined working terminal temperature.

According to such a structure, when the TiAl based alloy material is cooled from the equilibrium range of the α phase, strain, which become the starting point for the occurrence of lamellar grains, are introduced into the matrix by the high-speed plastic working. As a result, lots of lamellar grains having a small grain diameter are formed, to thereby form a fine structure.

The lower limit of the equilibrium temperature range of the α phase of the TiAl based alloy containing Al in an amount of from 43 to 48 atomic %, ranges from 1150° C. to 1250° C. depending on the composition. Therefore, after the TiAl based alloy is held in the equilibrium temperature range of the α phase of from 1230° C. to 1400° C., the TiAl based alloy is subjected to high-speed plastic working, while being cooled to 1200° C. which is the terminal temperature of the high-speed plastic working, and distortion which becomes the starting point for the formation of lamellar grains is given to thereby obtain a fine structure. The adequate cooling rate at this time is from 50 to 700° C./min. Moreover, a forging process, a rolling process or the like can be used as the above described high temperature plastic working.

In the production method of the above described TiAl based alloy, the TiAl based alloy material may be held at the above described holding temperature with the material being covered with a thermal insulation material, and then the TiAl based alloy may be subjected to high-speed plastic working, together with the thermal insulation material.

With such a construction, the temperature drop of the material during the high-speed plastic working can be suppressed, and normal apparatus can be applied as the apparatus for carrying out the high-speed plastic working, thereby making the process simple. Moreover, since a normal die can be used, and the size of the die can be freely set, a large TiAl based alloy product can be produced.

A method for obtaining the structure 2 described above, which is an other method for obtaining the TiAl based alloy of the present invention, is a production method of a TiAl based alloy characterized by comprising: a step for holding a TiAl based alloy material containing Al at least in an amount of from 38 to 44 atomic % in an equilibrium temperature range of a (α+β) phase; and a step for subjecting the TiAl based alloy material held at that temperature to high-speed plastic working, while cooling the material to a predetermined working terminal temperature.

Comparing this method with the above described method, since the material is held in the equilibrium temperature range of the (α+β) phase at a high temperature, and subjected to high-speed plastic working, with the soft β phase existing, workability is greatly improved. As a result, it is not necessary to cover the TiAl based alloy material with a thermal insulation material, as described above, and plastic working can be performed in a similar manner as with the normal metallic allows. Moreover, a larger structural parts can be produced.

The lower limit of the equilibrium temperature range of the (α+β) phase of the TiAl based alloy containing Al in an amount of from 38 to 44 atomic %, ranges from 1120° C. to 1220° C. depending on the composition. Therefore, after the TiAl based alloy is held in the equilibrium temperature range of the (α+β) phase of from 1000° C. to 1300° C., the TiAl based alloy is subjected to plastic working, while being cooled to 1120° C. which is the terminal working temperature, and distortion which becomes the starting point for the formation of lamellar grains is given to thereby obtain a fine structure. The adequate cooling rate in this case is similarly from 50 to 700° C./min. Moreover, a forging process, a rolling process or the like can be used as the above described high temperature plastic working.

The blade of the present invention is a blade using the TiAl based alloy obtained in the above described manner, having excellent ductility, and in particular, excellent impact properties.

The blade using such a material has an excellent impact value. As a result, if it is used for a turbine blade of a turbocharger or various types of turbine, it becomes possible to improve turbine efficiency due to the increase in rpm, and to contribute to lightening the weight, while maintaining reliability.

As is obvious from the above description, the TiAl based alloy of the present invention has a close arrangement of lamellar grains having a small grain diameter. Hence the metal microstructure becomes fine, to thereby improve the strength as well as toughness at room temperature, and in particular, impact properties.

Moreover, with the production method of the TiAl based alloy according to the present invention, when the TiAl based alloy material is cooled from the equilibrium temperature range of the $\alpha$ phase or the equilibrium temperature range of the $(\alpha+\beta)$ phase, distortion which becomes the starting point for the occurrence of lamellar grains is introduced into the matrix by high-speed plastic working. As a result, lamellar grains can be made fine. In addition, since the material is cooled at a relatively high speed after having been subjected to high-speed plastic working, the lamellar spacing in the lamellar structure can be made small.

The plastic workability at high temperatures is also improved, by holding the material in the $(\alpha+\beta)$ region. As a result, the material can be processed in normal industrial press, thereby making the TiAl based alloy material industrially advantageous.

Furthermore, if Cr or V is used as the additional element, a TiAl based alloy having excellent high temperature strength can be obtained, and if Mn is used, though the high temperature strength decreases, a TiAl based alloy having improved toughness and machinability can be obtained.

Since the blade according to the present invention has excellent impact resistance and strength, if this is used as a turbine blade for aircraft and ships, or for various industrial machines, such as gas turbines or steam turbines, it will be useful for improving the performance of the turbine and for lightening the weight.

DETAILED DESCRIPTION OF THE INVENTION

At first, a TiAl based alloy in a structure 1 of the present invention will be described.

Figure 1:
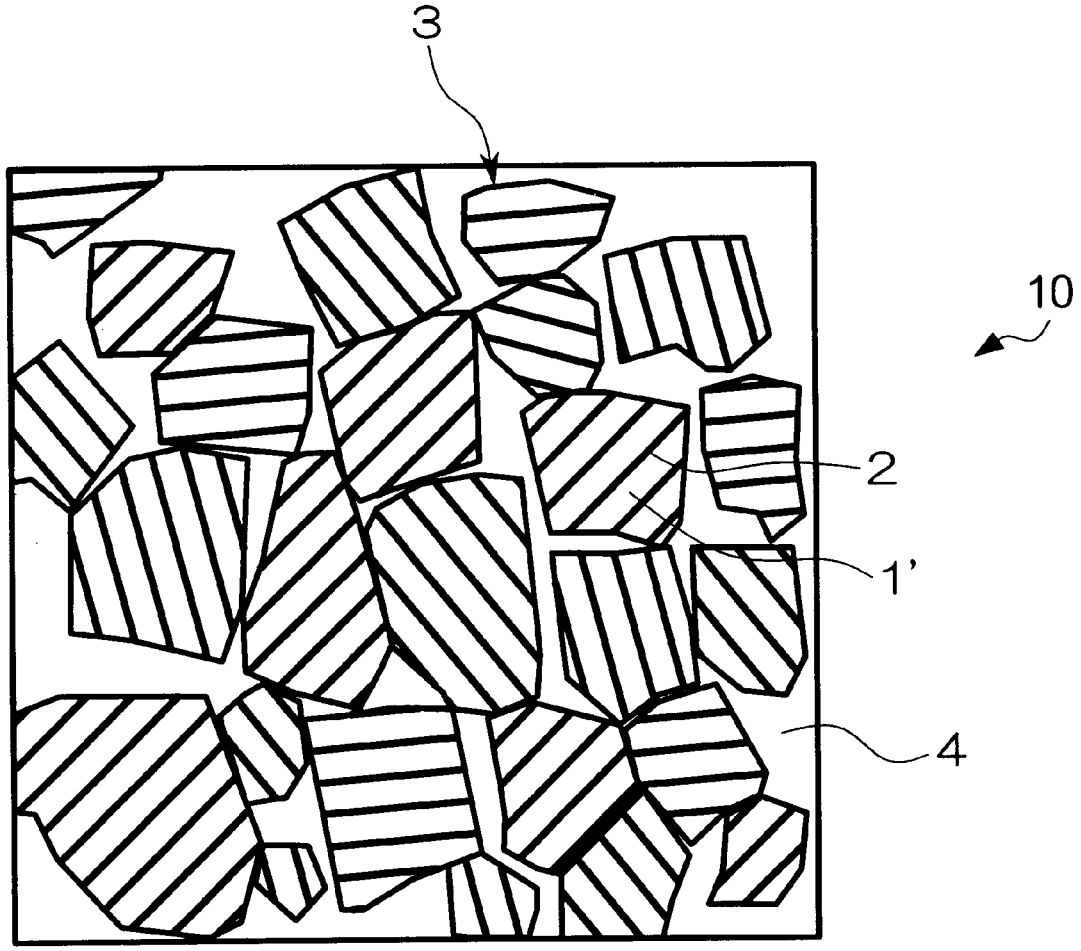
FIG. 1 is a diagram showing a microstructure of a TiAl based alloy in the structure 1 of the present invention.

FIG. 1 is a diagram of a microstructure of the TiAl based alloy in the structure 1 described above.

In FIG. 1, the TiAl based alloy 10 has a microstructure in which lamellar grains 3 having a mean grain diameter of from 1 to 50 $\mu$m are closely arranged, and a matrix 4 is formed between each lamellar grain 3. The lamellar grains 3 comprise a so-called lamellar structure in which $\alpha_2$ phase ($Ti_3Al$) 1' and $\gamma$ phase (TiAl) 2 are alternately laminated, and the lamination direction in each lamellar grain 3 is respectively different. The matrix 4 is composed mainly of the $\gamma$ phase. It is considered that since cracks occurring in the material become zigzag due to the lamellar structure having different lamination directions, the cracks hardly progress, thereby improving the toughness and strength of the material.

In the present invention, a feature in the microstructure is that the lamellar grains having a mean grain diameter of from 1 to 50 $\mu$m are closely arranged. More preferably, if the lamellar grains having a mean grain diameter of from 1 to 30 $\mu$m are closely arranged, the microstructure becomes finer, thereby improving ductility (impact property) at low temperatures. Moreover, if lamellar grains having a grain diameter of 20 $\mu$m or less are contained in an amount of 40% or more among all lamellar grains, this is more preferable from the view of making the microstructure finer, and improving ductility (impact property). Here, the "mean grain diameter" in the present invention is measured by a method specified in JIS-G0552.

"Closely arranged" in the present invention refers to a state in which when each lamellar grain is uniformly arranged in the microstructure, each lamellar grain comes relatively close, and specifically, it is defined as a state where the area ratio of the lamellar grains occupying is 60% or more, as seen in section of the microstructure. In this case, the rims of lamellar grains adjacent to each other in the course of growth of each lamellar grain collide with each other or come close to each other, and the matrix 4 is forced into narrow regions between adjacent lamellar grains. As a result, the matrix 4 alone does not occupy a large area (for example, an area corresponding to a lamellar grain having a mean grain diameter of 5 $\mu$m).

Here, it is industrially difficult to make the mean grain diameter of the lamellar grains less than 1 $\mu$m, and if the mean grain diameter exceeds 50 $\mu$m, ductility at room temperature, and in particular, impact properties decrease. If the lamellar grains having a mean grain diameter of from 1 to 50 $\mu$m, more preferably, lamellar grains having the mean grain diameter of from 1 to 30 $\mu$m are closely formed in the microstructure, the strength is improved by means of the lamellar grain itself. Furthermore, since lamellar grains having a small grain diameter come close to each other, the metal structure becomes fine, thereby improving toughness at room temperature, and in particular, impact properties. Moreover, as described below in detail, in the present invention, cooling is performed at a predetermined cooling speed, after hot forging, and this cooling speed is higher compared to a case, such as normal heat treatment, where cooling is gradually performed in a furnace. Hence the gap between the adjacent $\alpha_2$ phase and $\gamma$ phase (lamellar spacing) becomes narrower. As a result, an effect that the strength is improved can be also obtained. In this case, it is preferable to make the lamellar spacing 0.5 $\mu$m or less, for example. If the impact property of the TiAl based alloy of the present invention is expressed by a Charpy impact value at room temperature, which is specified in JIS-Z2242, it is possible to make the value 3J or higher, or 5J or higher according to the conditions.

Figure 2:
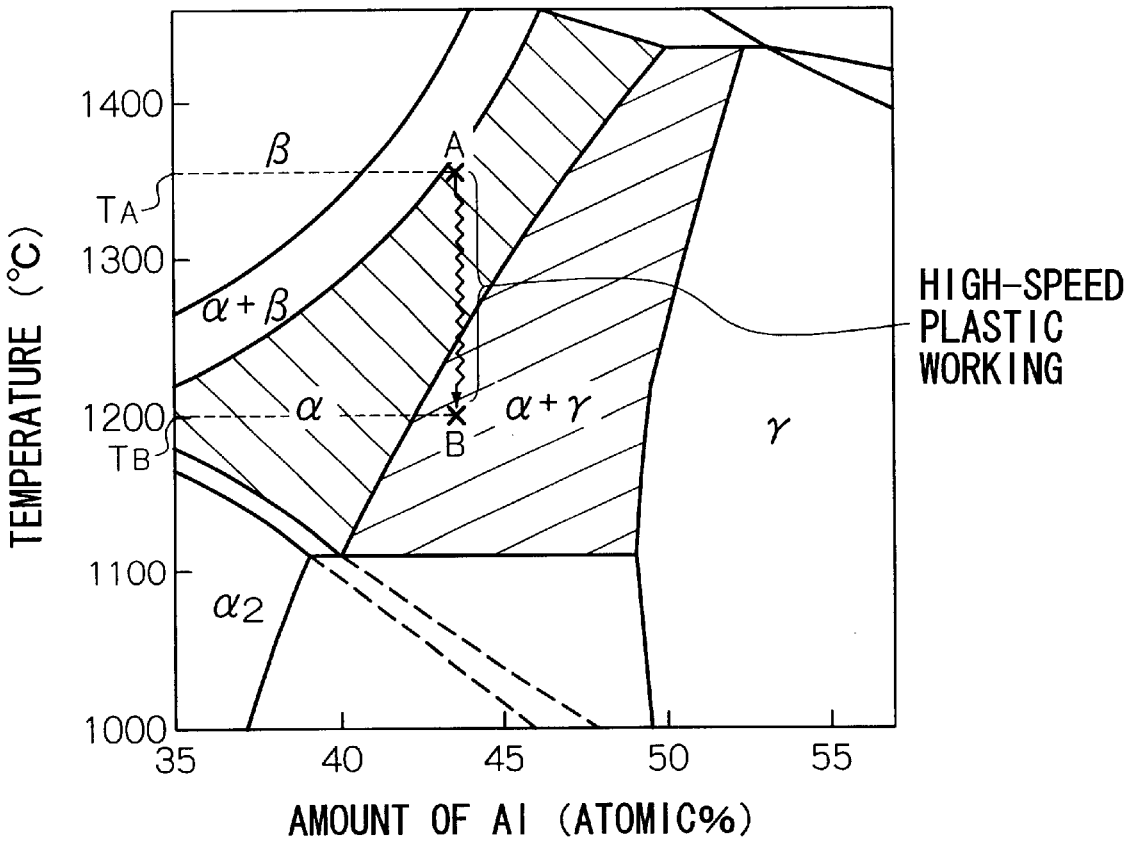
FIG. 2 is a phase diagram for explaining a process of the formation of a lamellar structure of a TiAl based alloy of the present invention.

The process of the formation of the TiAl based alloy in the structure 1 of the present invention will be described with reference to FIG. 2 and FIGS. 3A to 3C. FIG. 2 is for explaining each step corresponding to a phase diagram of a binary system of TiAl, and FIGS. 3A to 3C show the change in the microstructure in each step.

In FIG. 2, at first, the TiAl based alloy material having a predetermined composition, containing Al in an amount of from 43 to 48 atomic % is held at a temperature $T_A$ within a range of from 1230 to 1400° C., which is the equilibrium temperature range of the $\alpha$ phase (step A). Then, the material is subjected to high-speed plastic working, while being cooled from the holding temperature $T_A$ to the terminal temperature $T_B$ of the high-speed plastic working (step B). That is to say, the production method of the present invention can be said to be a kind of thermomechanical treatment, in terms of cooling the material from the $\alpha$ region to cause a phase transformation to a lamellar structure, and at the same time, performing plastic working. The microstructure formed in each step A and B in this manner will be described based on FIGS. 3A to 3C.

Figure 3A:
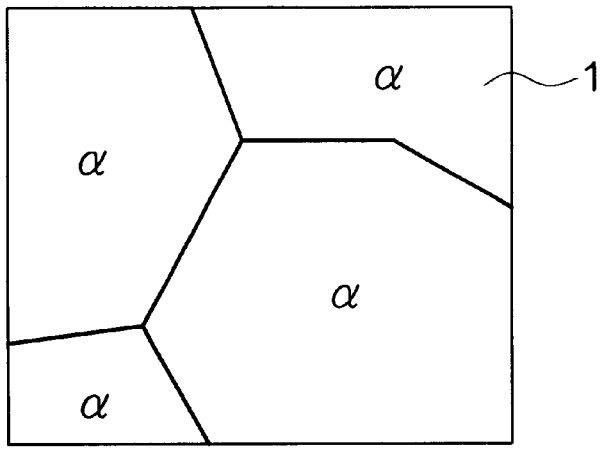
FIGS. 3A to 3C are diagrams showing the change in the microstructure in each step.
Figure 3B:
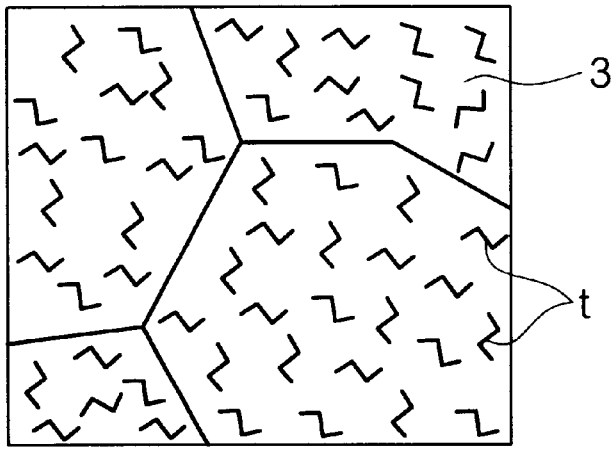
Figure 3C:
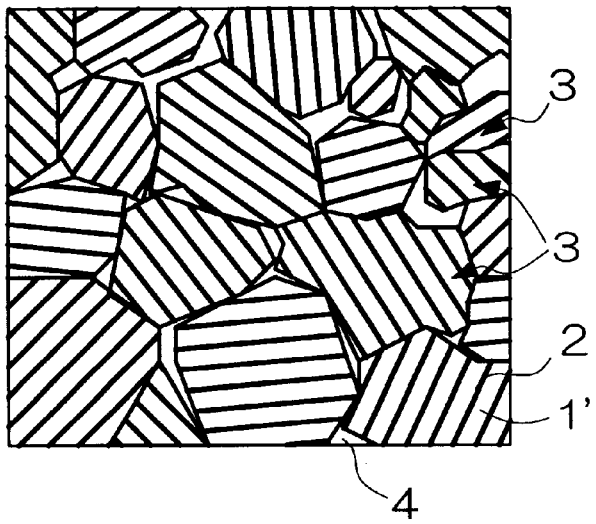

Referring to FIGS. 3A to 3C, in step A, being held at a temperature $T_A$ within a range of from 1230 to 1400° C., which is the equilibrium temperature range of the $\alpha$ phase, the microstructure consists of a single phase of $\alpha$ phase 1 being in the equilibrium state, and each $\alpha$ phase 1 is a relatively large grain (FIG. 3A). Then, in the stage progressing from step A to step B, before reaching the ($\alpha$+$\gamma$) phase in the equilibrium state, that is, in the state of $\alpha$ single phase or microstructure that some $\gamma$ phase is precipitated from the $\alpha$ phase, high-speed plastic working is performed immediately, and at this time, lots of distortions t are introduced into the microstructure. Then, with these distortions t as a starting point, the $\gamma$ phase is also precipitated from the $\alpha$ phase. Hence lots of lamellar grains 3 are formed in the microstructure (FIG. 3B). In step B, being the final stage of plastic working, before each lamellar grain 3 is fully grown, grain growth is hindered at a point of time when the adjacent lamellar grains 3 compete. As a result, a fine structure in which lots of lamellar grains 3 having a small grain diameter cluster together can be obtained. Here, the matrix between the lamellar grains is composed mainly of the $\gamma$ phase.

With the TiAl based alloy of a binary system, mechanical properties become favorable at Al concentrations of from 45 to 48 atomic %. As shown in FIG. 2 however, the temperature in the $\alpha$ phase region of the TiAl based alloy having such a component exceeds 1300° C., and it may be industrially difficult to hold the material at this temperature due to limitations in the performance of the heating furnace. Therefore, in such a case, the composition of the TiAl based alloy is changed, and the equilibrium temperature range of the $\alpha$ phase is decreased, utilizing the change of the phase diagram. Specifically, a TiAl based alloy of a multicomponent system, comprising 43 to 48 atomic % of Al, 5 to 10 atomic % of one or more kinds selected from Cr and V, with the remainder being Ti and inevitable impurities is used. By using at least one kind of Cr or V, the lower limit of the $\alpha$ phase in the equilibrium temperature range drops.

Figure 4:
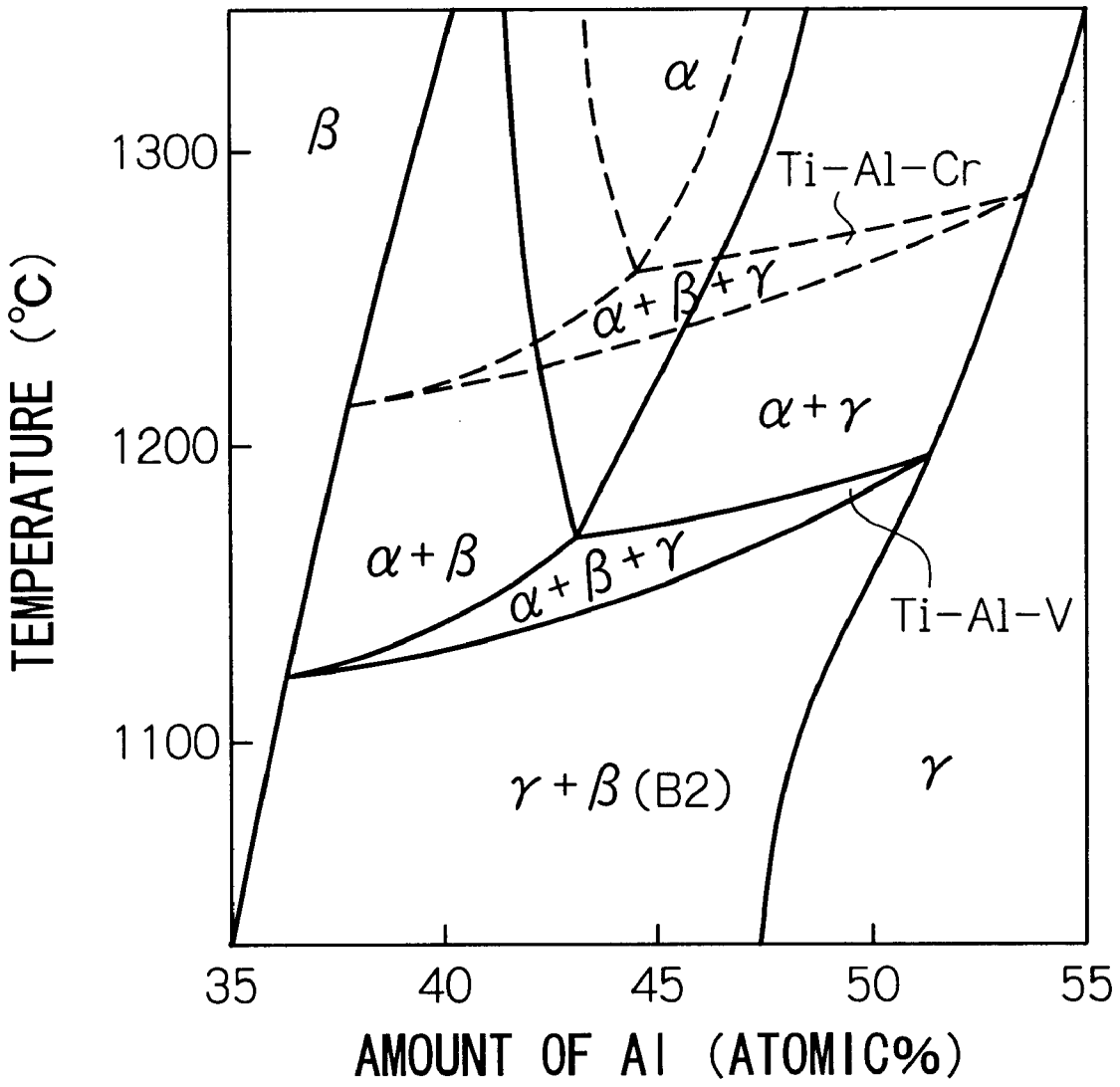
FIG. 4 is a phase diagram of a TiAl based alloy in a ternary compound system of the present invention.

The phase diagram of the ternary alloy with added Cr or V is shown in FIG. 4. The region represented by the broken line in the phase diagram of the figure shows the case for Ti—Al—Cr alloy (Cr: 10 atomic %), and the region represented by the solid line in the figure shows the case for Ti—Al—V alloy (V: 10 atomic %).

In FIG. 4, the lowest temperature in the equilibrium region of the $\alpha$ phase of the Ti—Al—Cr alloy is about 1250° C., and the $\alpha$ phase exists as a stable phase above this temperature. Moreover, the lowest temperature in the $\alpha$ phase region of the Ti—Al—V alloy is about 1150° C., and the $\alpha$ phase exists as a stable phase above this temperature. Therefore, if a multicomponent system TiAl based alloy containing the above described respective components is used, the holding temperature of the $\alpha$ phase in the equilibrium region can be made 1300° C. or less. Hence this is industrially advantageous in that a general heating furnace can be used.

These ternary TiAl based alloys have a characteristic that the $\beta$ phase is also stable in addition to the $\gamma$ phase, on the temperature lower than the limit of the $\alpha$ phase in the equilibrium temperature range. However, since the $\gamma$ phase is first precipitated from the $\alpha$ phase, the finally formed microstructure is almost the lamellar structure, and the $\beta$ phase slightly exists together with the $\gamma$ phase in part of the matrix. This $\beta$ phase becomes an ordered B2 structure at low temperatures.

Figure 5:
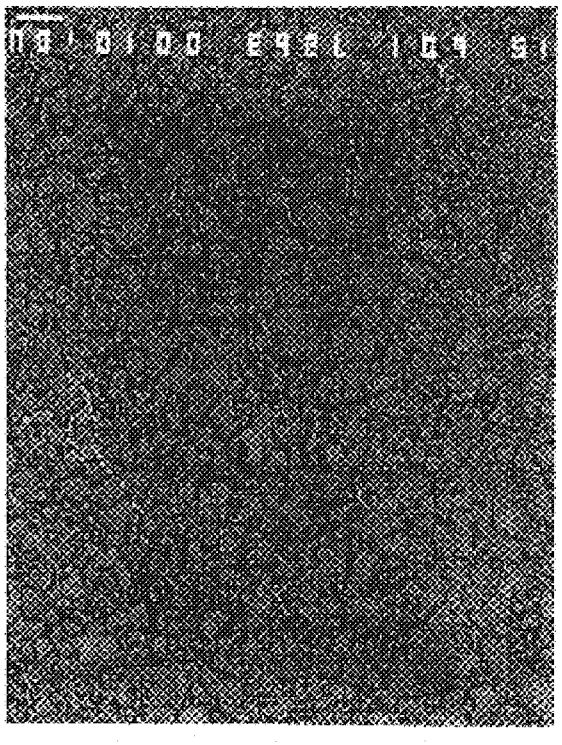
FIG. 5 is a photograph showing an electron microscopic structure of a TiAl based alloy in the structure 1 of the present invention.
Figure 6:
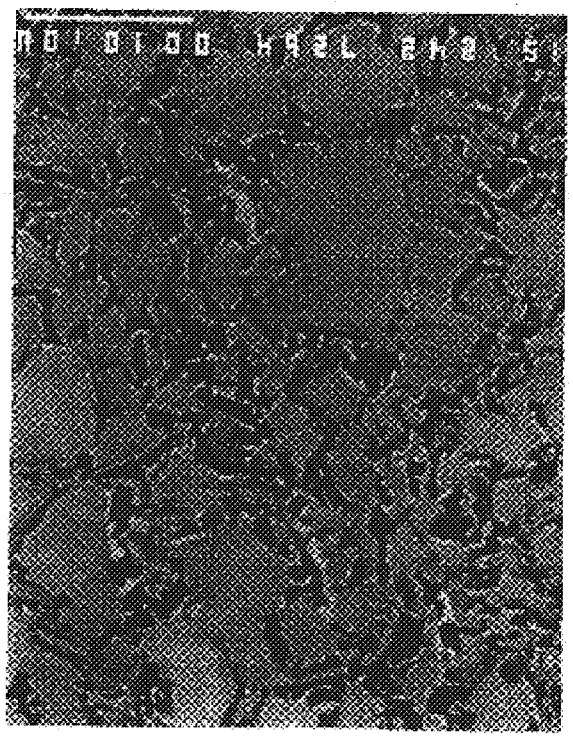
FIG. 6 is a photograph showing an electron microscopic structure of the TiAl based alloy in the structure 1 of the present invention, with the magnification being changed.

The microstructure of the TiAl based alloy of the present invention having such a composition is shown in FIG. 5 and FIG. 6.

As shown in FIG. 5, an electron microscopic structure of a TiAl based alloy containing 45 atomic % of Al, and 10 atomic % of V is such that lamellar grains having a small mean grain diameter are closely arranged, and a black or white matrix is formed between each lamellar grain. FIG. 6 shows an electron microscopic structure thereof with the magnification being further enlarged, and the black $\gamma$ phase and a few white shiny $\beta$ phase can be recognized between the lamellar grains.

In the above described example, description has been made of a case where either of Cr or V is added. However, both of Cr and V may be added so that the total amount is from 5 to 10 atomic %. Since the Ti—Al—Cr type alloy is more excellent in high temperature properties than the Ti—Al—V type alloy, it is better that the former is used for high temperature applications (for example, for turbine blades of gas turbines), and the latter is used for low temperature application (for example, for turbine blades of turbine engines for ships).

Moreover, an other one of the compositions of the TiAl based alloy 10 according to the present invention may use 4 to 10 atomic % of Mn instead of Cr or V. That is to say, the composition comprises 43 to 48 atomic % of Al, 4 to 10 atomic % of Mn, with the remainder being Ti and inevitable impurities.

The change on the phase diagram when Mn is used is substantially in the middle between the case for Cr and the case for V in FIG. 4. Hence the lower limit of the $\alpha$ phase in the equilibrium temperature range can be decreased.

By using Mn, the hardness of the $\alpha$ phase and the $\gamma$ phase constituting the lamellar structure can be decreased, to thereby make plastic working easy. Moreover, the impact resistance and the machinability required for subsequent turbine blade machining are improved.

On the contrary, if Mn is used, the hardness of each phase decreases. Hence the high temperature strength and the creep strength decrease slightly. Therefore, the temperature environment of use is limited to the low temperature region, but it can be used well for applications such as turbine blades of steam turbines.

Below is a description of a TiAl based alloy in the structure 2 in the present invention.

Figure 7:
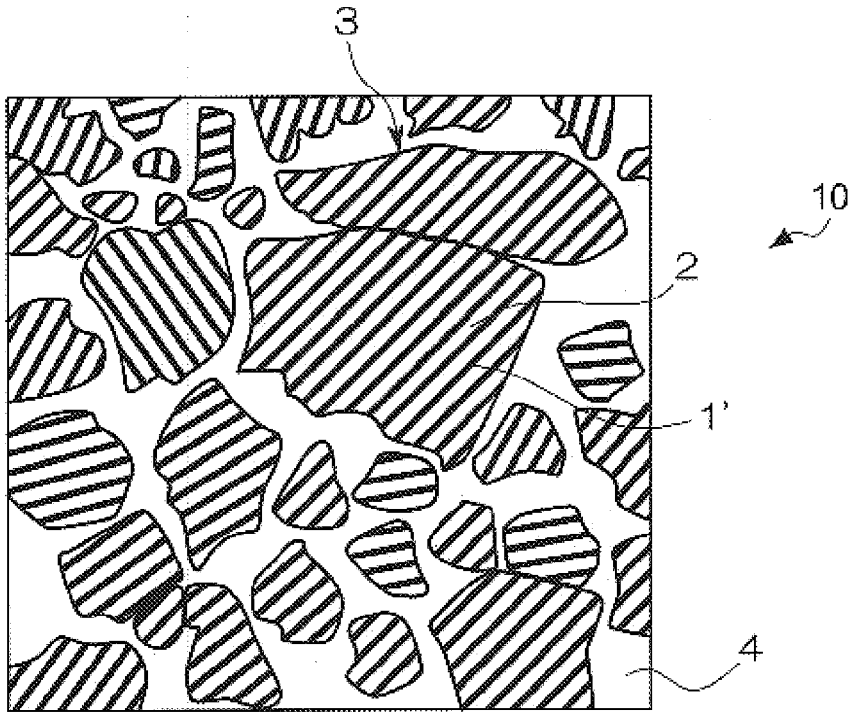
FIG. 7 is a diagram showing a microstructure of a TiAl based alloy in the structure 2 of the present invention.

FIG. 7 is a diagram showing a microstructure of a TiAl based alloy in the structure 2. In FIG. 7, the lamellar grains having a mean grain diameter of from 1 to 50 $\mu$m are the same as in the structure 1. Moreover, the area ratio of the matrix 4 is from 10% or higher to less than 40%, and the structure is such that the β phase and the γ phase are equiaxially complexed. The impact property and the strength due to fine lamellar grains are the same as for the above described structure 1. However with this structure 2, high temperature plastic workability is improved due to the effect of the β phase in the matrix.

In order to obtain this structure, it is necessary to hold the TiAl based alloy in the equilibrium region of the (α+β) phase. However, as shown in FIG. 2, with the binary TiAl based alloy, since the temperature becomes higher than the α region, this is industrially difficult. Therefore, in such a case, the composition of the TiAl based alloy may be changed to decrease the equilibrium region of the (α+β) phase. Specifically, a multicomponent TiAl based alloy comprising 40 to 44 atomic % of Al, 5 to 10 atomic % of one or more kinds selected from Cr and V, with the remainder being Ti and inevitable impurities may be used. By using at least one kind of Cr or V, the equilibrium region of the (α+β) phase expands, and also the temperature drops. The phase diagram of the ternary alloy with Cr or V added is as shown in FIG. 4, and the (α+β) phase region exists on the left side of the α phase region.

When these ternary TiAl based alloys are held in the (α+β) phase region, the α phase and the β phase coexist at high temperatures. Thereafter, when the ternary TiAl based alloys are subjected to high-speed working in the cooling process, the α phase changes to a fine lamellar structure in the same process as with the structure 1. Moreover, the γ phase is precipitated in the cooling process from the β phase, but since it does not form a specific crystal relationship, an equiaxial fine structure can be obtained. This β phase becomes an ordered B2 structure at low temperatures. The electron micrograph of this TiAl based alloy is shown in FIG. 8.

Figure 8:
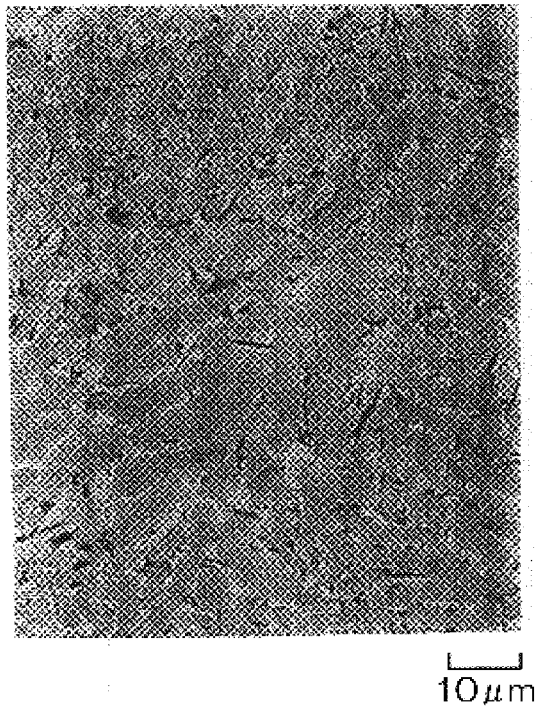
FIG. 8 is a photograph showing an electron microscopic structure of a TiAl based alloy in the structure 2 of the present invention.

As shown in FIG. 8, the electron microscopic structure of the TiAl based alloy containing 42 atomic % of Al and 10 atomic % of V is occupied by a fine structure comprising lamellar grains having a small mean grain diameter closely arranged therein, and the black γ phase and the white β phase exist on the matrix between the lamellar grains. In this example, description has been made of the case where either of Cr or V is added. However both of Cr and V may be added so that the total amount is from 5 to 10 atomic %.

Moreover, this microstructure of microstructure 2 of the TiAl based alloy according to the present invention may use 4 to 10 atomic % of Mn instead of Cr or V. In this case, the (α+β) phase expands slightly towards the left (to the side having low Al concentration) on the phase diagram shown in FIG. 4. That is to say, the composition comprises 38 to 44 atomic % of Al, 4 to 10 atomic % of Mn, with the remainder being Ti and inevitable impurities.

By using Mn, the hardness of the $\alpha_2$ phase and the γ phase constituting the lamellar grains can be decreased together with the β phase, to thereby make the plastic working easy. Moreover, the impact resistance and the machinability required for subsequent blade machining are improved.

On the contrary, if Mn is used, the hardness of each phase decreases. Hence the temperature environment for use is limited to the low temperature region.

Furthermore, both alloys in the structure 1 and structure 2 may contain, as other elements, 0.1 to 3 atomic % in total of one or more kinds selected from the group consisting of C, Si, Ni, W, Nb, B, Hf, Ta and Zr. These elements in small amounts appropriately improve the high temperature strength, creep strength and oxidation resistance. In this case, if the total content of each element is less than 0.1 atomic %, the above described effects are insufficient, and if the total content of each element exceeds 3 atomic %, the effects saturate, and decrease in the impact resistance occurs, which is not desirable.

(First Embodiment)

Here, in the above described high-speed plastic working, the plastic deformation ratio is made as high as 100% or more per second, to thereby give distortion which becomes the starting point for the lamellar structure. Since the material undergoes deformation under a high rate of strain, it is necessary to keep the material at as high a temperature as possible at the time of high-speed plastic working to thereby increase the deformation capacity. Accordingly, it is preferable to increase the terminal temperature $T_B$ of the plastic working to 1200° C. or higher. This is because if the terminal temperature $T_B$ of the plastic working is less than 1200° C., the material temperature at the time of working decreases, and hence the deformation capacity decreases, causing cracks in the material. Moreover, if the cooling speed from the α phase is too fast, massive transformation occurs, and the lamellar phase is not formed. If the cooling speed is too slow, the lamellar spacing expands to decrease the strength, which is not desirable. Therefore, it is preferable to set the cooling speed to, for example, about 50 to 700° C./min., so that a lamellar structure having narrow lamellar spacing can be formed.

As the high-speed plastic working, for example, forging or rolling may be used. In this case, if a material to be processed is taken out from a furnace after being held in the furnace at a predetermined holding temperature, the material cools quickly. Therefore, it may be difficult to keep the temperature of the material at 1200° C. or higher until completion of working, depending on the size of the material to be processed. Accordingly, in such a case, apparatus for normal working can be directly used by applying a production method shown in FIGS. 9A to 9D.

Figure 9A:
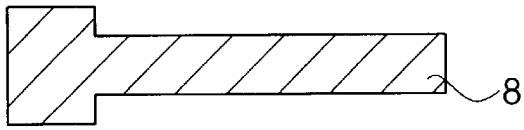
FIGS. 9A to 9D are process diagrams showing one example of a method of producing the TiAl based alloy of the present invention.
Figure 9B:
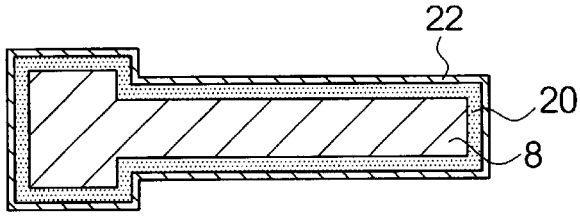

That is to say, in FIGS. 9A to 9D, a TiAl based alloy material 8 is first prepared (FIG. 9A). As this TiAl based alloy material 8, any material may be used, such as cast material, wrought material (isothermal forging material, hot working material) or the like.

The TiAl based alloy material 8 is covered with a thermal insulation material 20, and a cover 22 for supporting the thermal insulation material 20 is attached on the outside of the thermal insulation material 20. In this state, the material 8 is held in a furnace or the like, in which the temperature is kept at a holding temperature of the α phase region (step A' in FIG. 9B). The thermal insulation material 20 is for keeping the TiAl based alloy material 8 taken out from the furnace at a high temperature until completion of high-speed plastic working, and for keeping a predetermined cooling speed and preventing the material temperature from decreasing. The thermal insulation material 20 and the cover 22 are worked together with the TiAl based alloy material 8.

Therefore, as the thermal insulation material 20, a soft material such as $SiO_2$ or the like into a plate form or a cotton form is used, and as the cover 22, a sheet material or the like made of a steel which is easily plastically deformed is used.

Figure 9C:
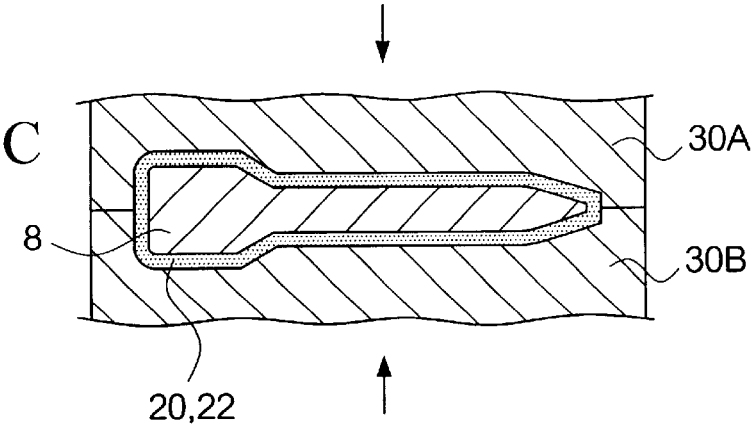
Figure 9D:
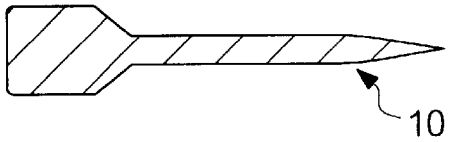

Then, the TiAl based alloy material 8 is taken out from the furnace together with the thermal insulation material 20 and the cover 22, and set up between an upper mold 30A and a lower mold 30B of a forging apparatus used for normal forging to be subjected for forging (step B' in FIG. 9C). At the time of forging, the TiAl based alloy material 8 is kept at a temperature close to the in-furnace temperature. As a result, the occurrence of forging cracks or the like is prevented, and phase transformation is caused to occur at an adequate cooling speed, and hence the lamellar grains are stably formed. In this manner, the final product (TiAl based alloy 10) having a microstructure shown in FIG. 3C is obtained (FIG. 9D). Here, appropriate post-processing, heat treatment or the like may be applied to this final product.

As described above, if the production method shown in FIGS. 9A to 9D is adopted, a normal forging apparatus can be applied, making the apparatus simple. Moreover, since it is not necessary to use a special heat resistant die (for example, Mo alloy such as TZM) as in isothermal forging which has heretofore been performed with respect to the TiAl based alloy, a normal die can be used and the size of the die can be freely set. As a result, a large sized TiAl based alloy product can be produced. Here, forging has been described above as an example, but the present invention is not limited thereto, and for example, rolling may be performed. In this case, a sheet form TiAl based alloy can be produced.

(Second Embodiment)

Below is a description of a second embodiment of the present invention.

The second embodiment of the present invention is for holding the TiAl based alloy in the equilibrium temperature range of the ($\alpha$+$\beta$) phase in the phase diagram of FIG. 4 described above, and using the $\beta$ phase which is soft and easily workable to effect high-speed plastic working. Since the $\beta$ phase remains in a relatively large amount even after the plastic working, the high temperature strength, and in particular, the creep strength decrease. However, it is well usable for a blade of a turbine for ships or the like, used at somewhat lower temperatures.

The microscopic structure in the second embodiment of the present invention is as shown in FIG. 8 described above.

Next, a production method of the TiAl based alloy in the second embodiment will be described.

The mechanism of the formation of lamellar grains in the second embodiment is similar to the case of the first embodiment described above. Here, the high-speed plastic working method will be described with reference to the phase diagram.

In FIG. 4, for example, the lowest temperature in the equilibrium region of the ($\alpha$+$\beta$) phase of the Ti—Al—Cr type alloy is about 1220° C., and the ($\alpha$+$\beta$) phase exists as a stable phase above this temperature. Moreover, the lowest temperature in the ($\alpha$+$\beta$) phase region of the Ti—Al—V type alloy is about 1120° C., and the ($\alpha$+$\beta$) phase exists as a stable phase above this temperature. Therefore, if the ternary TiAl based alloy containing the above described respective components is used, the holding temperature of the ($\alpha$+$\beta$) phase in the equilibrium region can be made to be not higher than 1300° C., from 1150 to 1300° C., and preferably from 1200° C. to 1250° C. The terminal temperature of the high-speed plastic working can be dropped up to 1000° C. by means of the effect of the $\beta$ phase having excellent deformation capacity. As a result, thermal insulation is not particularly required, and the material can be fabricated by a forging method or rolling method of a normal metallic material, which is industrially advantageous. Moreover, the $\beta$ phase has the advantage of improving the machinability at the time of fabrication of a blade, which is the step after forging. It is suitable to make the area ratio of the $\beta$ phase occupying the microstructure to be 10% to 40%.

Finally, a blade using the TiAl based alloy of the present invention, having these compositions will be described.

Figure 10:
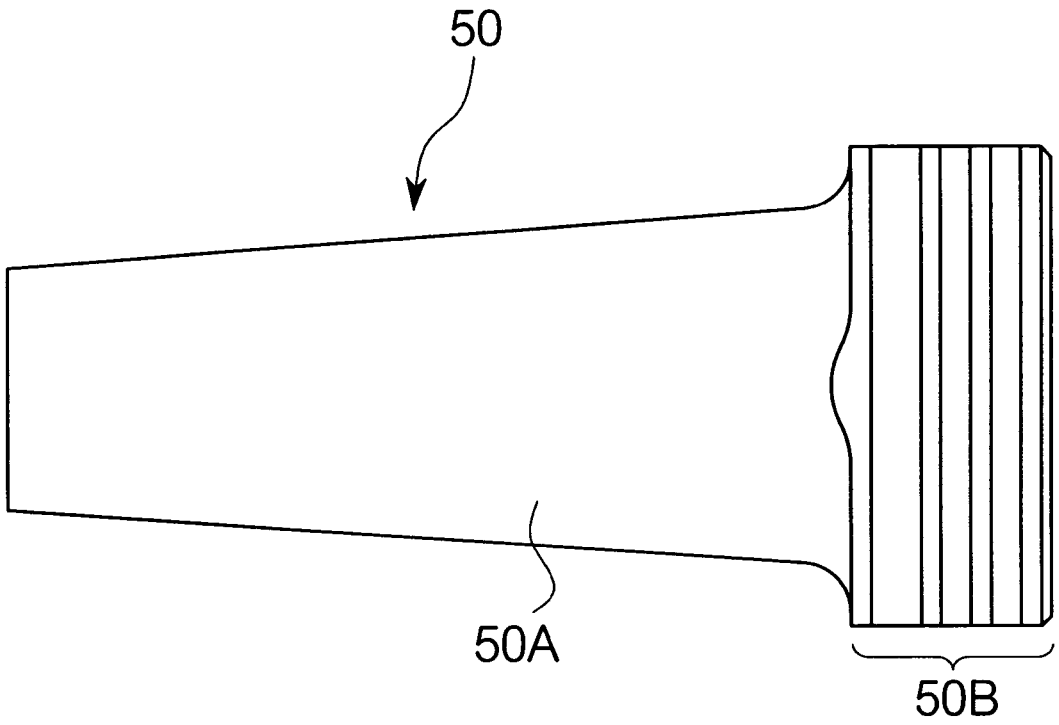
FIG. 10 is a perspective view showing a blade of the present invention.

FIG. 10 illustrates the visual shape of the blade. In this blade shown in FIG. 10, the blade 50 comprises a profile 50A and a root 50B. The root 50B is driven into a slot on the outer periphery of a disc shaped disk (not shown) to constitute the whole turbine rotor. In addition to the above described blade 50, the disk itself may be produced by using the TiAl based alloy of the present invention.

Since the blade of the present invention is lightweight and has excellent impact resistance, it can be used for blades of aircraft or ships, or blades of various industrial machines, such as gasturgines or steam turbines, thereby contributing to high performance and lightening of turbines, while maintaining reliability.

EXAMPLES

Example 1

1. Manufacture of a TiAl Based Alloy Material

After a TiAl based alloy having a composition of 45 atomic % of Al, 10 atomic % of V, with the remainder being Ti and inevitable impurities was melted by a plasma skull method, the TiAl based alloy was cast to an ingot, and then appropriately cut out and subjected to surface finishing, to thereby obtain an ingot material in a columnar shape having a diameter of 95 mm and a length of 109 mm.

2. Heat Insulation Treatment of the Material

This ingot material was covered with a thermal insulation sheet made of Isowool (mixture of alumina and silica) having a thickness of 3 mm, and further the outside of the thermal insulation sheet was covered with a cover made of Cr—Mo steel. The outer diameter including the cover was 115 mm. This heat insulation sheet had a thermal insulation performance such that the time for cooling an object held at 1250° C. to 1200° C. was 3 minutes.

3. Pre-Working of the Material (Extrusion)

This ingot material with the cover was held in a furnace at 1250° C. for 1 hour, and then taken out from the furnace and subjected to one pass extrusion (extruding speed: 30 mm/s). Extrusion was performed in 30 seconds after taking out from the furnace. The size of the extruded material itself was 40 mm diameter×300 mm, and the outer size including the cover was 48 mm diameter×320 mm.

4. High-speed Plastic Working (Forging)

The thermal insulation sheet and cover which covered the extruded material were removed and the surface of the extruded material was smoothed. Then, the thermal insulation sheet and the cover were attached again to the extruded material in the same manner as described above, and was held at 1250° C. for 1 hour, and then taken out and forged into a predetermined shape by a press of 2800 tons so that the thickness of the extruded material itself became 10 mm to make it flat. Forging was performed in 30 seconds after taking out from furnace, and the material was air-cooled and left after being forged, to thereby obtain a sample of lamellar grains having a mean grain diameter of 4 μm.

Comparative Examples 1–3

As a comparison, Ti-47Al-2Cr-2Nb (atomic %) alloy was melted by a plasma skull melting, to obtain an ingot having the same size as above, and this ingot was subjected to isothermal forging at 1100° C., until it had a thickness of one fourth of the initial thickness. Thereafter, the ingot was heat treated at 1400° C. for 10 minutes, to obtain a sample of lamellar grains having a mean grain diameter of 100 μm. This was designated as Comparative Example 1. In addition, one obtained by casting Ti-47Al-2Cr-2Nb (atomic %) alloy was designated as Comparative Example 2. Moreover, one obtained by casting using Inconel 713C was designated as Comparative Example 3. The processing methods of these sample materials are shown in Table 1.

3. Property Evaluation of Samples After Forging

Tensile strength of sample materials of Example 1 and Comparative Examples 1 to 3 was measured by an ordinary method at room temperature and at a high temperature (700° C.).

Figure 11:
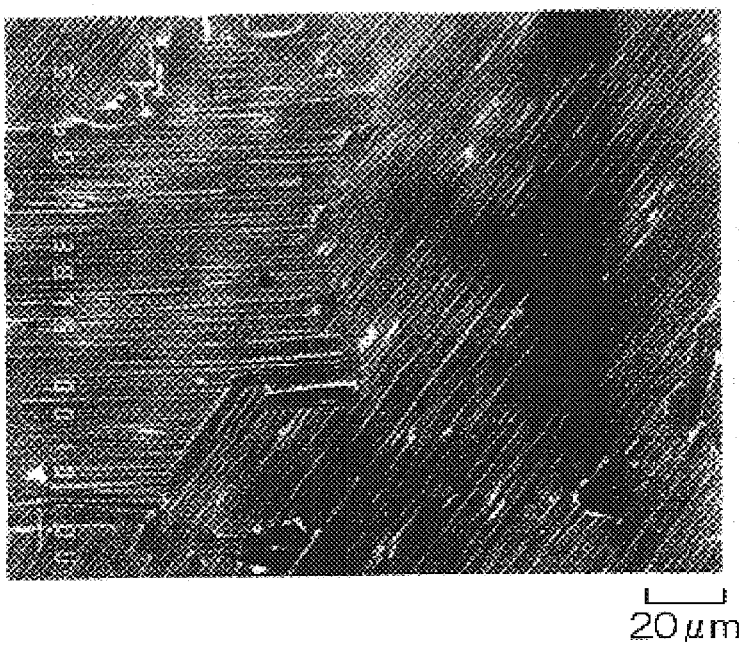
FIG. 11 is a photograph showing an electron microscopic structure in a comparative example 2.
Figure 12:
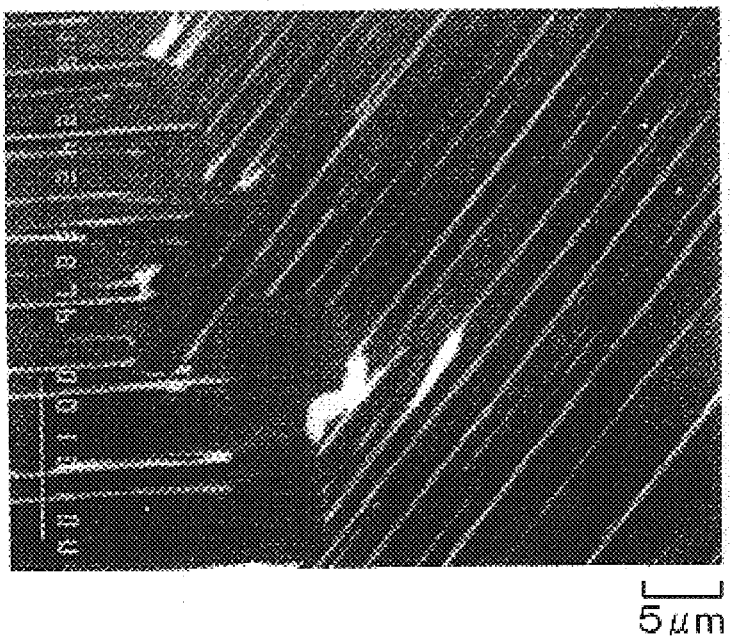
FIG. 12 is a photograph showing an electron microscopic structure in the comparative example 2, with the magnification being changed.

Moreover, these sample materials were subjected to the Charpy impact testing specified in JIS-Z2242 at room temperature. Respective results are shown in Table 2. Photographs showing the electron microscopic structure are shown in FIG. 5 and FIG. 6. Furthermore, photographs of the electron microscopic structure in Comparative Example 2 are shown in FIG. 11 and FIG. 12.

TABLE 1

| | Alloy composition (atomic %) | Holding temperature (° C.) (equilibrium phase) | High-speed plastic working method |
|---|---|---|---|
| Example 1 | Ti—45Al—10V | 1250 (α) | Extrusion → Upsetting |
| Comp. Ex. 1 | Ti—47Al—2Cr—2Nb | 1100 | Isothermal forging |
| Comp. Ex. 2 | Ti—47Al—2Cr—2Nb | — | (caast material) |
| Comp. Ex. 3 | Inconel 713C | — | (cast material) |

TABLE 1-continued

| | Alloy composition (atomic %) | Holding temperature (° C.) (equilibrium phase) | High-speed plastic working method |
|---|---|---|---|
| Example 2 | Ti—40Al—10V | 1250 (α + β) | Cogging |
| Example 3 | Ti—45Al—5Mn | 1250 (α) | Upsetting |
| Example 4 | Ti—40Al—7Mn | 1250 (α + β) | Cogging |
| Example 5 | Ti—45Al—10V—0.2C | 1250 (α) | Upsetting |
| Example 6 | Ti—45Al—10V—1Ni | 1250 (α) | Upsetting |

TABLE 2

| | Mean grain diameter of lamellar grain (μm) | Tensile str. (MPa) Room temp. | Tensile str. (MPa) 700° C. | Charpy impact value (J) | Hardness at room temperature (Hv) | Oxidation weight gain ($g/m^2$) at 800° C. × 500 h |
|---|---|---|---|---|---|---|
| Example 1 | 4 | 1082 | 1245 | 5 | 380 | 110 |
| Comp. Ex. 1 | 100 | 673 | 686 | 1 | — | — |
| Comp. Ex. 2 | 150 | 494 | 530 | 1 | — | — |
| Comp. Ex. 3 | — | 847 | 890 | 12 | — | — |
| Example 2 | 5 | 1230 | 1053 | 5 | 360 | — |
| Example 3 | 8 | 1010 | 1160 | 7 | 310 | — |
| Example 4 | 6 | 1090 | 970 | 8 | 290 | — |
| Example 5 | 5 | 1110 | 1320 | 3 | 400 | — |
| Example 6 | 6 | — | — | — | — | 30 |

As is obvious from Table 1 and Table 2, in Example 1, the tensile strength at room temperature and 700° C. and the Charpy impact test value are both excellent.

On the other hand, in Comparative Example 1 and Comparative Example 2 where the mean grain diameter of lamellar grains are 100 μm and 150 μm respectively, both the tensile strength and the Charpy impact value at room temperature decrease considerably. In the case of Comparative Example 3 comprising inconel 713C, though this is excellent in the Charpy impact value at room temperature, the tensile strength is lower than in Example 1, and since the specific gravity is twice as large as the TiAl based alloy, the specific strength (strength/specific gravity) required as a rotating parts further decreases.

Example 2

As shown in Table 1, after a TiAl based alloy having a composition of 40 atomic % of Al, 10 atomic % of V, with the remainder being Ti and inevitable impurities was melted by a plasma skull method, the TiAl based alloy was cast to an ingot having a diameter of 95 mm and a length of 120 mm. This ingot was inserted into a furnace without devising any special heat insulation means, and held at 1250° C., which is a stable temperature region of the (α+β) phase. Thereafter, the ingot taken out from the furnace was subjected to forging, using an ordinary forging apparatus. The forging were performed by pressing the sides of the ingot twice in succession by rotating the ingot through 90 degrees, after which the ingot was returned into the furnace and reheated. This operation was repeated, to thereby obtain a TiAl based alloy material having a size of 50 mm×50 mm×340 mm, without causing any defects such as cracks.

The photograph of the electron microscopic structure of the TiAl based alloy material obtained in this manner is as shown in FIG. 8. It can be seen that black portions or white matrix fills the gaps between the lamellar grains. Comparing with the photograph of the electron microscopic structure of the TiAl based alloy in Example 1 shown in FIG. 5 and FIG. 6, it is seen that more white β phase exist.

Moreover, various properties of the TiAl based alloy material obtained in this manner were measured in a similar manner to in Example 1. These results are also shown in Table 2. In the TiAl based alloy in Example 2, much of the β phase exist, and as shown in Table 2, though hardness at room temperature and the tensile strength at high temperatures slightly decrease in comparison with Example 1, the Charpy impact value is equivalent. That is, it can be said that the TiAl based alloy in Example 2 has excellent workability at high temperatures, and impact resistance.

Example 3

As shown in Table 1, after a TiAl based alloy having a composition of 45 atomic % of Al, 5 atomic % of Mn, with the remainder being Ti and inevitable impurities was melted by a plasma skull method, the TiAl based alloy was cast into an ingot having a diameter of 95 mm and a length of 120 mm. This ingot was inserted into a furnace with heat insulation being applied as in Example 1, and held at 1250° C., which is a stable temperature region of the α phase. Thereafter, the ingot taken out from the furnace was subjected to upsetting, using an ordinary forging apparatus, with the heat insulation treatment. The upsetting was performed by compressing the upper and lower faces of the ingot once to make a disc having a diameter of 190 mm and a thickness of 30 mm, without causing any defects such as cracks.

The electron microscopic structure of the disc-shaped TiAl based alloy material obtained in this manner exhibited a structure similar to that of Example 1.

Moreover, various properties of the TiAl based alloy material obtained in this manner were measured in a similar manner to in Example 1. These results are also shown in Table 2. Since the TiAl based alloy in Example 3 contains Mn, hardness at room temperature decreases and the tensile strength also decreases, but the Charpy impact value is improved. Furthermore, since hardness decreases, machining becomes easy.

Example 4

As shown in Table 1, after a TiAl based alloy having a composition of 40 atomic % of Al, 7 atomic % of Mn, with the remainder being Ti and inevitable impurities was melted by a plasma skull method, the TiAl based alloy was cast into an ingot having a diameter of 95 mm and a length of 120 mm. This ingot was inserted into a furnace without devising any special heat insulation means as in Example 2, and held at 1250° C., which is a stable temperature region of the (α+β) phase. Thereafter, the ingot taken out from the furnace was subjected to forging, using an ordinary apparatus in the same manner as in Example 2. The forging were performed by pressing the sides of the ingot twice in succession by rotating the ingot through 90 degrees, after which the ingot was returned into the furnace and reheated. This operation was repeated, to thereby obtain a TiAl based alloy material having a size of 50 mm×50 mm×340 mm, without causing any defects such as cracks.

The electron microscopic structure of this TiAl based alloy material obtained in this manner exhibited a structure similar to that of Example 2.

Moreover, various properties of the TiAl based alloy material obtained in this manner were measured in a similar manner to in Example 1. These results are also shown in Table 2. With the TiAl based alloy in Example 4, hardness at room temperature and the tensile strength decrease in comparison with Example 2, but the Charpy impact value is improved. Furthermore, since it is soft, machining becomes easy.

Example 5

As shown in Table 1, after a TiAl based alloy having a composition of 45 atomic % of Al, 10 atomic % of V, 0.2 atomic % of C, with the remainder being Ti and inevitable impurities was melted by a plasma skull method, the TiAl based alloy was cast into an ingot having a diameter of 95 mm and a length of 120 mm. This ingot was inserted into a furnace with heat insulation being applied as in Example 1, and held at 1250° C., which is a stable temperature region of the α phase. Thereafter, the ingot taken out from the furnace was subjected to upsetting, using an ordinary forging apparatus, with the heat insulation treatment. The upsetting was performed by compressing the upper and lower faces of the ingot once to process into a disc having a diameter of 190 mm and a thickness of 30 mm, without causing any defects such as cracks.

The electron microscopic structure of the disc-shaped TiAl based alloy material obtained in this manner exhibited a structure similar to that of Example 1.

Moreover, various properties of the TiAl based alloy material obtained in this manner were measured in a similar manner to as described above. These results are also shown in Table 2. The TiAl based alloy in Example 5 greatly improves, in particular, the high temperature strength, in comparison with the alloy in Example 1, whose composition is the same as this alloy except for C, but on the contrary, the Charpy impact test value slightly decreases. That is, it is seen that C causes a slight decrease in the impact value with respect to the TiAl based alloy of the present invention, but is very effective in improvement of the high temperature strength. This effect can be similarly seen for Si, B and Ta.

Example 6

As shown in Table 1, after a TiAl based alloy having a composition of 45 atomic % of Al, 10 atomic % of V, 1 atomic % of Ni, with the remainder being Ti and inevitable impurities was melted by a plasma skull method, the TiAl based alloy was cast into an ingot having a diameter of 95 mm and a length of 120 mm. This ingot was inserted into a furnace with heat insulation being applied as in Example 1, and held at 1250° C., which is a stable temperature region of the α phase. Thereafter, the ingot taken out from the furnace was subjected to upsetting, using an ordinary apparatus, with the heat insulation treatment. The upsetting was performed by compressing the upper and lower faces of the ingot once to process into a disc having a diameter of 190 mm and a thickness of 30 mm, without causing any defects such as cracks.

The electron microscopic structure of the disc-shaped TiAl based alloy material obtained in this manner exhibited a structure similar to that of Example 1.

Furthermore, the TiAl based alloy material obtained in this manner and the alloy in Example 1 were subjected to an atmospheric oxidation test at 800° C. for 500 hours, and oxidation resistance thereof was compared from the oxidation weight gain. The results are also shown in Table 2. With the TiAl based alloy in Example 6, the weight gain greatly decreases compared to the alloy in Example 1 having the same composition as this alloy except for Ni. That is to say, it is seen that Ni is very effective for improving the oxidation resistance of the TiAl based alloy of the present invention. This effect is also exerted by W, Nb, Hf and Zr.

What is claimed is:

1. A TiAl based alloy having a microstructure in which lamellar grains having a mean grain diameter of from 1 to 50 $\mu$m are closely arranged, with an $\alpha_2$ phase and a $\gamma$ phase being laminated therein alternately, and a matrix comprising a $\beta$ phase filling the gaps between the lamellar grains, comprising 40 to less than 44 atomic % of Al, 5 to 10 atomic % of at least one element selected from the group consisting of Cr and V, with the remainder being Ti and inevitable impurities.

2. A TiAl based alloy according to claim 1, having a microstructure in which lamellar grains having a mean grain diameter of from 1 to 50 $\mu$m are closely arranged, with an $\alpha_2$ phase and a $\gamma$ phase being laminated therein alternately, and a matrix comprising a $\beta$ phase filling the gaps between the lamellar grains, comprising 38 to less than 44 atomic % of Al, 4 to 10 atomic % of Mn, with the remainder being Ti and inevitable impurities.

3. A TiAl based alloy according to claim 1, containing at least one element selected from the group consisting of C, Si, Ni, W, Nb, B, Hf, Ta, and Zr in an amount of from 0.1 to 3 atomic % in total.

4. A TiAl based alloy according to claim 2, containing at least one element selected from the group consisting of C, Si, Ni, W, Nb, B, Hf, Ta, and Zr in an amount of from 0.1 to 3 atomic % in total.

5. A TiAl based alloy according to claim 1, wherein V is present.

* * * * *